US006371188B1

(12) United States Patent
Baczuk et al.

(10) Patent No.: US 6,371,188 B1
(45) Date of Patent: Apr. 16, 2002

(54) DOORS ASSEMBLY AND AN IMPROVED METHOD FOR MAKING A DOORS SILL ASSEMBLY

(75) Inventors: Eric Baczuk, Kannapolis; Daniel A. Jackson, Concord, both of NC (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/594,777

(22) Filed: Jun. 16, 2000

Related U.S. Application Data

(60) Provisional application No. 60/139,576, filed on Jun. 17, 1999.

(51) Int. Cl.[7] ..... A47H 1/00

(52) U.S. Cl. ..... 160/92; 49/467; 49/471; 52/204.1

(58) Field of Search ..... 49/467, 468, 469, 49/470, 471, 504, 142, 143; 52/204.1, 209; 160/92

(56) References Cited

U.S. PATENT DOCUMENTS

| | | | | |
|---|---|---|---|---|
| 258,486 | A | | 5/1882 | Singer |
| 385,065 | A | | 6/1888 | Milroy |
| 448,501 | A | | 3/1891 | Bussert |
| 582,451 | A | | 5/1897 | Brannon |
| 586,467 | A | | 7/1897 | Vogel |
| 719,672 | A | | 2/1903 | Jewell |
| 837,474 | A | | 12/1906 | Jewell |
| 1,995,858 | A | | 3/1935 | Mearns, Jr. |
| 2,696,028 | A | | 12/1954 | Miller |
| 2,875,481 | A | | 3/1959 | Erkkila |
| 3,410,027 | A | * | 11/1968 | Bates ..... 49/471 |
| 3,729,870 | A | | 5/1973 | Kvalheim et al. |
| 3,774,343 | A | | 11/1973 | Cribben et al. |
| 3,900,967 | A | | 8/1975 | Bursk et al. |
| 3,990,187 | A | | 11/1976 | Brown et al. |
| 4,055,917 | A | | 11/1977 | Coller |
| 4,237,664 | A | * | 12/1980 | Wilmes ..... 49/471 |
| 4,310,991 | A | | 1/1982 | Seely |
| 4,555,882 | A | | 12/1985 | Moffitt et al. |
| 5,012,614 | A | | 5/1991 | Shea |
| 5,018,307 | A | | 5/1991 | Burrous et al. |
| 5,067,279 | A | * | 11/1991 | Hagemeyer ..... 49/471 |
| 5,136,814 | A | | 8/1992 | Headrick |
| 5,179,804 | A | | 1/1993 | Young |
| 5,283,977 | A | | 2/1994 | Smith |
| 5,325,648 | A | | 7/1994 | Ménard |
| 5,542,217 | A | | 8/1996 | Larivee, Jr. |
| 6,138,413 | A | * | 10/2000 | Fehr ..... 49/382 |

* cited by examiner

*Primary Examiner*—Jerry Redman
(74) *Attorney, Agent, or Firm*—Pillsbury Winthrop LLP

(57) ABSTRACT

The present application generally relates to door frame assemblies and door sill assemblies. One aspect relates to a door sill assembly having an open fluid receiving trough in its sub-sill. Another aspect relates to a door sill assembly having a tread structure that includes a lip for supporting a rectilinearly movable door panel with a groove adjacent the lip for guiding fluid on the tread structure to opposing ends thereof.

44 Claims, 5 Drawing Sheets

DOORS ASSEMBLY AND AN IMPROVED METHOD FOR MAKING A DOORS SILL ASSEMBLY

The present application claims priority to U.S. Provisional Appln. of Baczuk et al., Ser. No. 60/139,576, filed Jun. 17, 1999, the entirety of which is hereby incorporated into the present application by reference.

FIELD OF THE INVENTION

The present invention relates to a door assembly that comprises a door frame assembly that mounts within an exterior doorway of a building and a door panel that opens and closes over the doorway. In particular, the present invention relates to an improved door sill assembly and an improved method for making a door sill assembly.

BACKGROUND AND SUMMARY OF THE INVENTION

One of the traditional problems faced when constructing door assemblies that mount within a doorway on a building exterior is preventing water and other liquids from flowing through the door frame assembly, specifically at the lower edge thereof where the door sill assembly is located. Conventionally, door sill assemblies have used a sub-sill that is capable of receiving water and draining it out to the building exterior and the tread is provided with a weep system that allows water to flow into the sub-sill. One problem with these conventional arrangements is that the side jambs of the frame are attached to the outside of the sub-sill ends, thereby creating a potential for water to flow between the sub-sill ends and the side jambs. To solve this problem, gaskets or similar rubber seals have been provided between the side jambs and the sub-sill to prevent such leakage. These gaskets add extra cost to the door frame assembly and may still not solve the potential leakage problem if they are improperly positioned between the sub-sill ends and the side jambs. Water that leaks between the door sill assembly and the door panel can flow into the building interior and create puddles or damages floor treatments, such as carpeting. Also, some of this water may possibly leak between the door sill assembly and the building floor into the building sub-floor where over time it can cause the wood components in the building sub-floor to rot, thereby incurring the high expense associated with tearing up the building floor and re placing sub-floor components.

Another problem with some known door sill assemblies is that the sub-sills have a low fluid capacity. In high wind conditions, wind can blow into the drainage system and increase the pressure inside the sub-sill. Without a sufficient volume to accommodate this increase in pressure, the sub-sill may not function effectively to drain the fluid therein. Further, in arrangements that use grooves to guide the water to the drainage openings, such as the assembly disclosed in U.S. Pat. No. 3,900,967, the wind may displace some of the fluid and force it back out through its weepholes.

Consequently, there exists a need for a door frame assembly that includes an improved high volume door sill assembly that functions effectively to prevent water from draining into the building sub-floor. To meet this need, one aspect of the present invention provides a door frame assembly constructed and arranged to be installed in a doorway located at an exterior of a building in conjunction with a door panel movable between open and closed positions with respect to the doorway. The door frame assembly comprises first and second side jambs constructed and arranged to be mounted along first and second generally vertically extending sides of the doorway and a door sill assembly constructed and arranged to be mounted along a lower edge of the doorway between the first and second side jambs. The door sill assembly comprises a sub-sill having a peripheral wall including a bottom wall, first and second end walls extending generally upwardly from the bottom wall at opposing end portions of the sub-sill, a rear wall extending longitudinally between the end walls, and a front wall extending longitudinally between the end walls opposite the rear wall. The walls of the sub-sill provide interior surfaces that cooperate to define an open fluid-receiving trough extending between the front and rear walls and the first and second end walls. The peripheral wall has one or more openings formed therethrough to allow fluid in the trough to drain from the trough to the building exterior when the door frame assembly is installed in the doorway with the front wall facing the building exterior. The end and rear walls are constructed and arranged to prevent fluid in the trough from flowing into the building interior.

A tread structure is mounted to the sub-sill so as to cover the sub-sill. The tread structure and the sub-sill are constructed and arranged such that fluid flowing over the tread structure towards building interior is directed into the trough of the sub-sill and then is allowed to drain out from the trough to the building exterior through the one or more openings in the peripheral wall of the sub-sill. The first and second side jambs and the door sill assembly are constructed and arranged such that the first and second side jambs connect to the opposing end portions of the sub-sill with portions of the first and second side jambs extending inside the first and second end walls, respectively, and downwardly into the trough adjacent opposing end portions of the tread structure so that fluid flowing over the tread structure towards the building interior adjacent to the first and second side jambs is allowed to flow downwardly into the trough of the sub-sill between the tread structure and the side jambs and then is allowed to drain out from the trough to the building exterior through the one or more openings in the peripheral wall of the sub-sill.

Thus, it can be appreciated that the door sill assembly of the present invention provides an effective arrangement for draining water and other liquids flowing through or attempting to flow through the doorway and preventing the water or other liquids from leaking into the sub-floor between the door jambs and the sub-sill. The open trough of the sub-sill provides the door sill assembly with a relative large fluid capacity for handling fluid drainage in comparison to the prior art arrangements that use narrow grooves for guiding the fluid. The advantage of this open trough construction is that, when a high wind is blowing directly on the building exterior, the wind may blow into the sub-sill via its openings. Because of the sub-sill's open trough arrangement, the wind can flow over the top of the water contained in the trough and out through the weepholes. This prevents the wind from creating a high pressure situation in the trough.

Related aspects of the invention also provide the door sill assembly for use in the door frame assembly, and the entire door frame assembly which includes the door panel itself.

Another aspect of the invention relates specifically to door frame assemblies of the type that are used in conjunction with a door panel that is movable between its open and closed positions in a generally rectilinear manner, such as a conventional sliding or rolling door panel. In these types of arrangements, the tread structure on the door sill assembly is typically provided with a door panel supporting lip that extends generally upwardly therefrom for supporting the rectilinearly movable door panel. Fluid flowing over the tread structure tends to become trapped behind the lip, thus providing a supply of fluid that can flow into the building interior. To obviate this problem, this aspect of the invention provides a door frame assembly constructed and arranged to be installed in a doorway located at an exterior of a building in conjunction with a door panel movable in a generally rectilinear manner between open and closed positions with respect to the doorway. The door frame assembly comprises first and second side jambs constructed and arranged to be mounted along first and second generally vertically extending sides of the doorway and a door sill assembly constructed and arranged to be mounted along a lower edge of the doorway between the first and second side jambs. The door sill assembly comprises a sub-sill having surfaces defining an interior fluid receiving space which has one or more openings to allow fluids therein to drain therefrom to the building exterior when the door frame assembly is installed in the doorway. The sub-sill is constructed and arranged to prevent fluid in the fluid receiving space from flowing into the building interior.

A tread structure is mounted to the sub-sill so as to cover the sub-sill. The tread structure and the sub-sill are constructed and arranged such that fluid flowing over the tread structure towards the building interior is directed into the fluid receiving space of the sub-sill and then is allowed to drain out to the building exterior through the one or more openings. The tread structure provides a door panel supporting lip extending generally upwardly therefrom. The lip is constructed and arranged such that the rectilinearly movable door panel can be mounted on the lip and supported thereby for generally rectilinear movement between opened and closed positions. The tread structure also has structure that cooperates with the lip to define a groove extending alongside the lip rearwardly thereof. The groove is configured to guide fluid flowing over the lip towards the opposing ends of the tread structure for drainage to the exterior of the building. The first and second side jambs and the door sill assembly are constructed and arranged such that the first and second side jambs connect to the opposing end portions of the sub-sill in such a manner that fluid flowing over the tread structure towards the building interior adjacent to the first and second side jambs is allowed to flow downwardly into the fluid receiving space of the sub-sill between the tread structure and the side jambs and then is allowed to drain out to the building exterior through the one or more openings.

Related aspects of the invention also provide the door sill assembly for use in the door frame assembly, and the entire door frame assembly which includes the door panel itself.

Another aspect of the invention relates to a method for making a door sill assembly. Typically, the sub-sill is injection molded as one piece and then the tread structure is extruded, cut to a length corresponding to the length of the sub-sill, and assembled to the sub-sill. The problem with this conventional method is that it is not cost-effective for constructing door sill assemblies of varying lengths. Specifically, doorways usually come in a standard number of widths and it is desirable to provide door frame assemblies for each of these standard widths. To accomplish this using one-piece sub-sills, a separate injection molding die must be used for the sub-sill of each length of door sill assembly or separate molding cavities for sub-sill portions of different lengths must be formed in a single molding die. The tread structure does not pose a significant problem because it is extruded and may be formed to length. The costs associated with using separate injection molds for each sub-sill length, however, can be quite prohibitive.

Thus, there exists a need for an improved method of making a door sill assembly that is more cost-effective than the conventional method described above. To meet this need, another aspect of the invention provides a method for making door sill assemblies of varying lengths, the door sill assemblies being constructed and arranged to be installed along lower edges of doorways located at the exteriors of buildings in conjunction with first and second side jambs that are constructed and arranged to be installed along generally vertically opposing sides of the doorways. The method comprises forming a plurality of first sub-sill portions each having generally the same length and forming a plurality of second sub-sill portions of varying lengths including at least (a) second sub-sill portions each having a first length that will provide a first completed sub-sill with a first predetermined total length selected to extend along the lower edge of a selected doorway between first and second side jambs when the second sub-sill portions having the first length are each connected to the first sub-sill portions and (b) second sub-sill portions each having a second length different from the first length that will provide a second completed sub-sill with a second predetermined total length selected to extend along the lower edge of another selected doorway between first and second side jambs when the second sub-sill portions having the second length are each connected to the first sub-sill portions. The second sub-sill portions having the first length are connected to a first multiplicity of the first sub-sill portions to form a multiplicity of first completed sub-sills each having the aforesaid first predetermined total length and the second sub-sill portions having the second length are connected to a second multiplicity of the first sub-sill portions to form a multiplicity of second completed sub-sills each having the aforesaid second predetermined total length. A plurality of tread structures of varying lengths are provided, including at least a multiplicity of first tread structures having lengths corresponding to the first predetermined total length and a multiplicity of second tread structures having lengths corresponding to the second predetermined total length. The first tread structures are connected over the first completed sub-sills so that the first tread structures cover the first completed sub-sills. The second tread structures are connected over the second completed sub-sills so that the second tread structures cover the second completed sub-sills.

It can be appreciated that making the door sill assembly in accordance with the principles of this aspect of the invention obviates the need for separate molding dies because the length of one of the sub-sill portions is selected to provide the entire sub-sill with on overall length suitable for mounting along the lower edge of the doorway. That is, the length of only one sub-sill portion is varied and the remaining sub-sill portion(s) remains fixed. The length of that one portion can be varied simply by consistently forming it in a maximum length and then cutting it down to its desired size. Alternatively, an injection mold with a cavity corresponding to the maximum size of the varied length portion may be used and inserts can be placed in the mold to provide the portion with varying sizes.

Other objects, advantages, and features of the present invention will become apparent from the following detailed description, the accompanying drawings, and the appended claims.

DETAILED DESCRIPTION OF THE PREFERRED EMBODIMENT OF THE INVENTION

Figure 1:
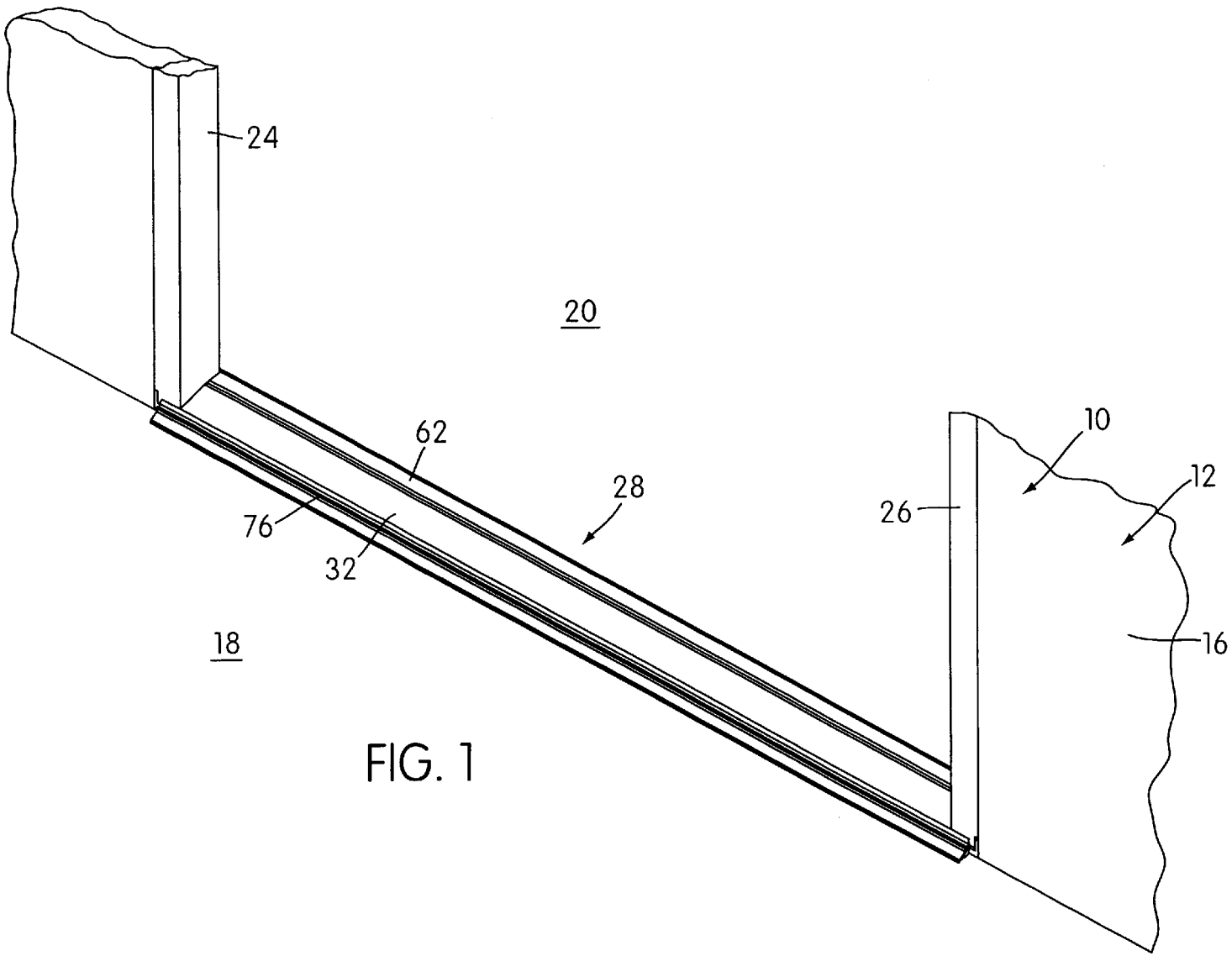
FIG. 1 is a partial perspective showing a door frame assembly with a door sill assembly constructed in accordance with the principles of the present invention mounted within a doorway on the exterior of a building.

FIG. 1 shows a perspective view of part of a door frame assembly, generally indicated at 10, mounted in a doorway, generally indicated at 12, formed through an exterior wall 16 of a building. The building exterior is indicated 18 and the building interior is indicated 20. The frame assembly 10 comprises a top rail (not shown) that extends along an upper edge of the doorway 12 when the frame assembly 10 is installed, first and second side jambs 24, 26, respectively, that extend along opposing vertical sides of the doorway 12 when the frame assembly is installed, and a door sill assembly, generally indicated at 28, that extends along a lower edge of the doorway 12 when the frame assembly 10 is installed. A door panel (not shown) mounts within the frame assembly 10 for movement between open and closed positions with respect to the doorway 12. The door panel may be a single door panel pivotally mounted to one of the side jambs 24,26, a pair of pivotally mounted door panels each mounted to one of the side jambs 24,26, a single sliding door panel mounted for rectilinear sliding or rolling movement relative to the doorway 12, or a pair of sliding panels mounted for rectilinear sliding or rolling movement.

Figure 2:
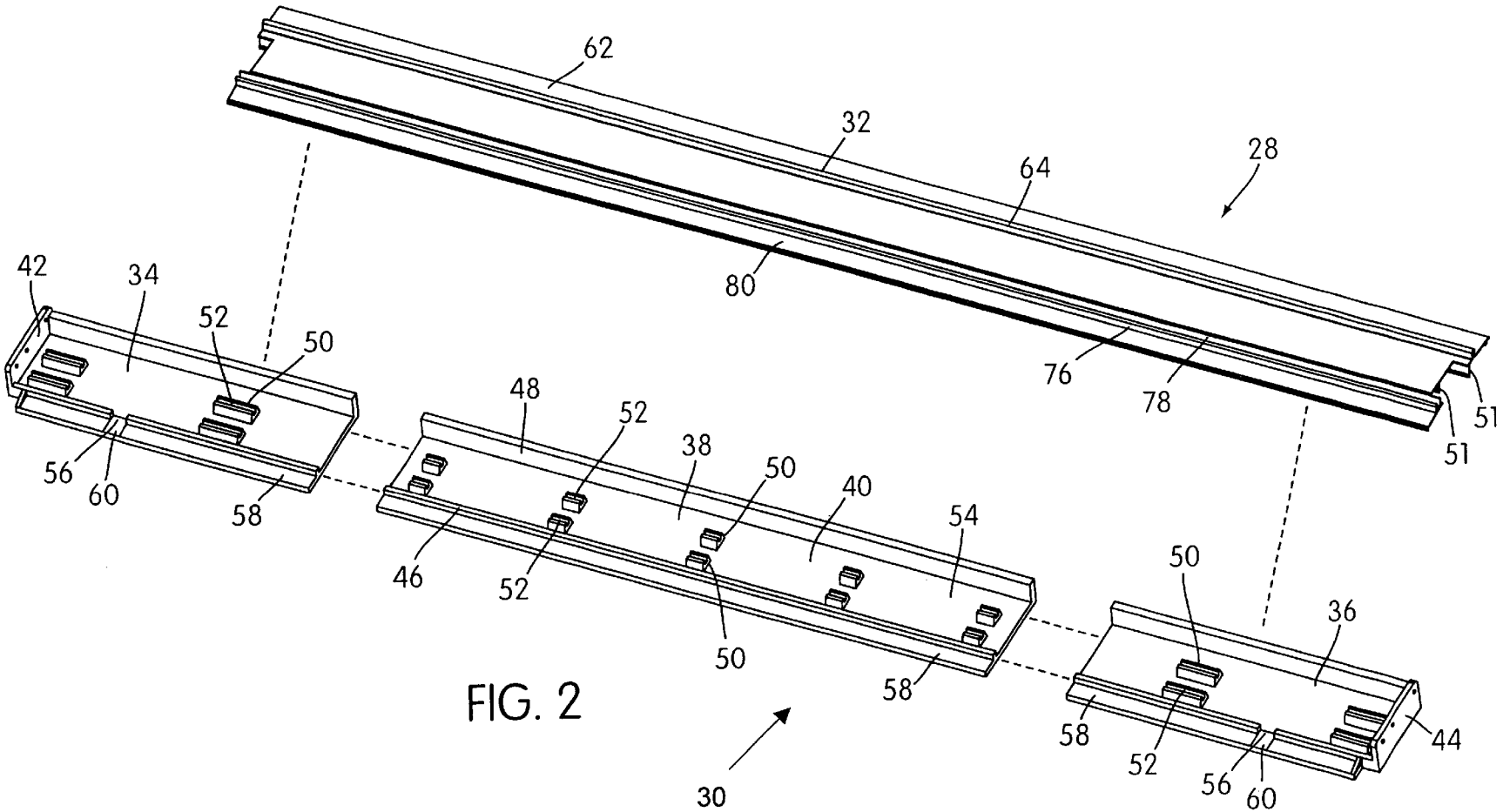
FIG. 2 is an exploded perspective view showing the components of the door sill assembly illustrated in FIG. 1.

As shown in FIG. 2, the door sill assembly 28 comprises a molded plastic sub-sill 30 and a tread structure 32 formed from a rigid material, such as metal or a glass-filled thermoplastic. The sub-sill 30 is assembled by connecting first and second sub-sill end portions 34,36 to opposing end portions of an intermediate sill portion 38. It is to be understood that in practicing certain aspects of the invention, the sub-sill 30 may be formed as one piece. However, as will become appreciated later in the application, one aspect of the invention contemplates forming sub-sills of varying lengths from separate components.

The sub-sill 30 has a generally planar bottom wall 40 and first and second end walls 42,44 extending upwardly from the bottom wall 40 at opposing end portions of the sub-sill 30. The sub-sill 30 also has a front wall 46 extending upwardly from the bottom wall 40 between the end walls 42,44 and a rear wall extending upwardly from the bottom wall between the end walls 42,44 opposite the front wall 46. The height of the front wall 46 is shorter than that of the rear wall 48. For example, in a preferred embodiment, the front wall 46 is 0.25 inches high from the interior surface of the bottom wall 40 and the rear wall 48 is 1.25 inches high from the interior surface of the bottom wall 40. Each of the walls 42,44,46,48 is generally planar and extends at generally a right angle with respect to the bottom wall 40.

The bottom wall 40 also has a plurality of integrally formed mounting structures 50 extending upwardly therefrom. These mounting structures 50 are aligned in two parallel rows along the length of the sub-sill 30. Each of these mounting structures 50 has an upwardly facing groove 52. The grooves 52 of the mounting structures 50 in each row are aligned with one another and are configured to receive portions of the tread structure 32 therein. Specifically, the tread structure 32 has a pair of longitudinally extending mounting members 51 depending downwardly from the underside thereof. When the door sill assembly 28 is assembled, the mounting members 51 of the tread structure 32 are received in the grooves 52 so that the grooves 52 and the mounting members 51 cooperate to properly align the tread structure 32 with respect to the sub-sill 30 and to support the tread structure 32 against collapse when persons step thereon.

The walls 42,44,46,48 of the sub-sill 30 have interior surfaces that cooperate to define a trough 54 that is capable of receiving a volume of fluid therein. The front wall 46 has a pair of openings 56 formed therein that allow fluid to drain outwardly from the trough 54. When the door sill assembly 28 is assembled and mounted along the lower edge of the doorway 12, the front wall 46 is located on the exterior of the building and allows fluid in the trough 54 to drain to the building exterior. An exterior flange 58 extends forwardly from the front wall 46 and has grooves 60 adjacent and communicating with the openings 56. These grooves 60 guide fluid draining from the trough 54 through the openings 56 away from the front wall 46. The rear and end walls function as a dam that blocks the flow of fluid into the building interior or sub-floor.

Figure 5:
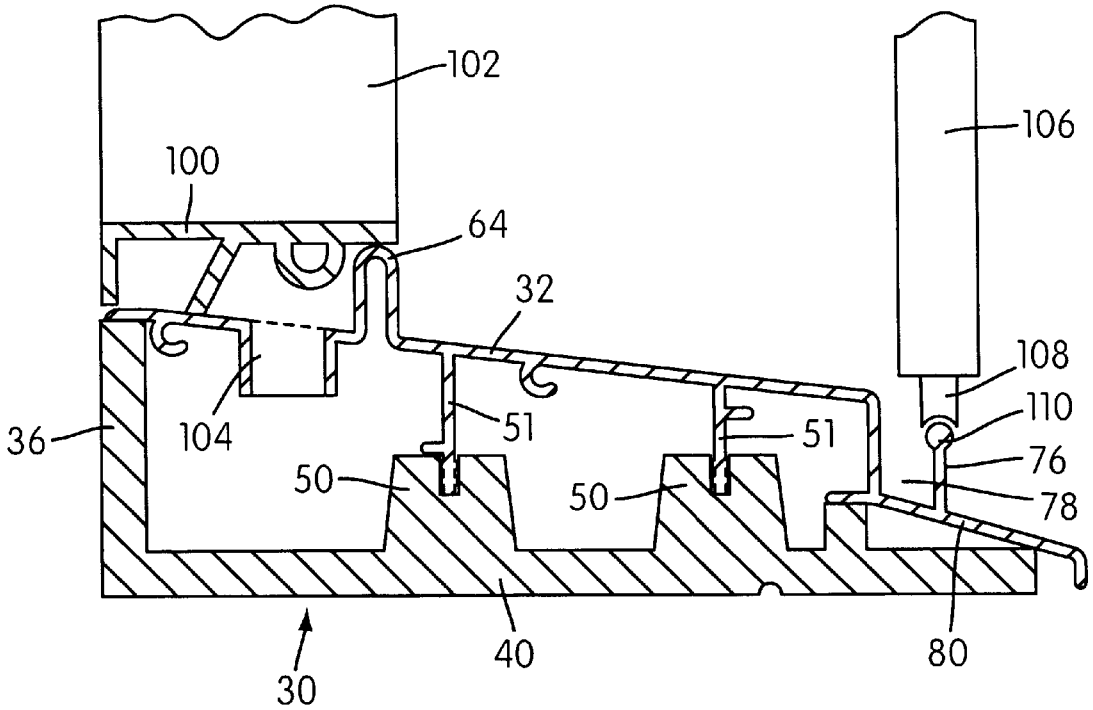
FIG. 5 is a cross-sectional view showing the door sill assembly of the present invention being used in conjunction with a pivoting door panel and a sliding screen door.

The tread structure 32 is extruded so as to form the mounting members 51 on the underside thereof and so as to provide the tread structure 32 with an upwardly facing surface 62 that tightly engages with the weather stripping shown at 100 in FIG. 5 on the underside of the door panel 102 when closed to prevent air or water from entering the building between the door panel and the tread structure 32. The tight engagement between the surface 62 and the door panel may not be with the actual panel itself and may be with a guide rail that guides the lower edge of a sliding door panel. The tread structure 32 also has a lip 64 extending upwardly therefrom adjacent the surface 62. This lip 64 is positioned so as to be flush with the closed door panel when the door assembly 10 is installed and serves two purposes. The first purpose is to provide protection against the ingress of water and air between the door panel and the tread structure 32. Specifically, the lip 64 sealingly engages with the weather stripping 100 on the underside of the door panel 102 so as to block liquid or air from seeping in between the tread structure 32 and the door panel. The second purpose is to guide fluids that seep between the door panel and the lip 64 into the sub-sill trough 54. Specifically, the lip 64 directs fluids that have managed to flow thereover laterally along the tread structure 32 and into the sub-sill trough 54 via a series of openings 66 (often referred to as "weepholes") formed though the upper wall of the tread structure 32 or between the ends of the tread structure 32 and the side jambs 24,26. These weepholes 66 are formed along the region where the lip 64 and the tread upper wall meet so that fluid flowing along interior side of the lip is guided laterally to one of the weepholes 66. As the fluid flows into the weepholes, it flows into the sub-sill trough 54 and then out to the exterior of the building via openings 56 and grooves 60. This prevents the fluid from draining into the building sub-floor to help prevent rotting of the wood components associated with the sub-floor.

FIG. 5 shows a cross-section of the tread structure 32. As best seen in the cross-sectional view, the tread structure is provided with a thermal block 104 that is positioned adjacent the lip 64 so as to be below the closed door panel 102 inside of the lip 64. The thermal block 104 is formed by creating a groove in the tread structure 32 during the extrusion thereof and then filling the groove with a molten resin having low thermal conductivity to form the thermal block 104. After the resin solidifies, the bottom wall of the groove is cut-off. As a result, the metal portions on opposing sides of the thermal block 104 are separated by the thermal block 104 with the block 104 functioning to inhibit heat transfer through the tread structure 32. Thus, the thermal block prevents heat loss from the building interior via the tread structure 32 when installed. If the tread structure 32 were metal throughout, then there is a potential for a relatively high heat loss via the tread structure 32 as a result of the naturally high thermal conductivity of metal.

The tread 32 also has a laterally extending lip 76 provided on a sloping portion 80 of the tread that slopes downwardly away from the door engaging surface 62. When the door frame assembly 10 is assembled and installed, the sloping portion 80 extends to the exterior of the building and the lip 76 is positioned on the exterior side of the door panel. This lip 76 serves dual purposes. The first purpose of lip 76 is to provide extra protection against water flowing into the building interior between the door panel and the tread structure 32. Specifically, the outermost lip 76 blocks groundwater from rain or the like from flowing up the tread structure 32. Any water that flows over the outermost lip 76 becomes entrapped in the groove or "moat" 78 formed between the lip 76 and the upper wall of the tread structure 32 and is guided laterally to the ends of the tread structure 32 for drainage. Any water that flows up over the lip 76, past the groove 78, and onto the door engaging surface 62 should be blocked by the inner lip 64 described earlier in the application.

The second purpose for lip 76 is to provide a structure for a sliding storm or screen door 106 to ride along. Specifically, FIG. 5 shows a sliding screen door 106 with a plurality of rollers 108 rotatably mounted on the underside thereof. The rollers 108 have concave circumferences that correspond to the rounded, convex free end 110 of the lip 76. The rollers are mounted on the lip free end 110 so that the lip 76 supports the door panel 106 and the rollers 108 roll along the lip free end 110 for rectilinear movement of the panel 106 between open and closed positions. Other suitable guide rails and the like are provided to assist in supporting the panel 106. The use of groove 78 in this arrangement is superior to known arrangements because it better facilitates the handling of fluids and functions effectively to guide fluids laterally to the ends of the door sill assembly.

Figure 3:
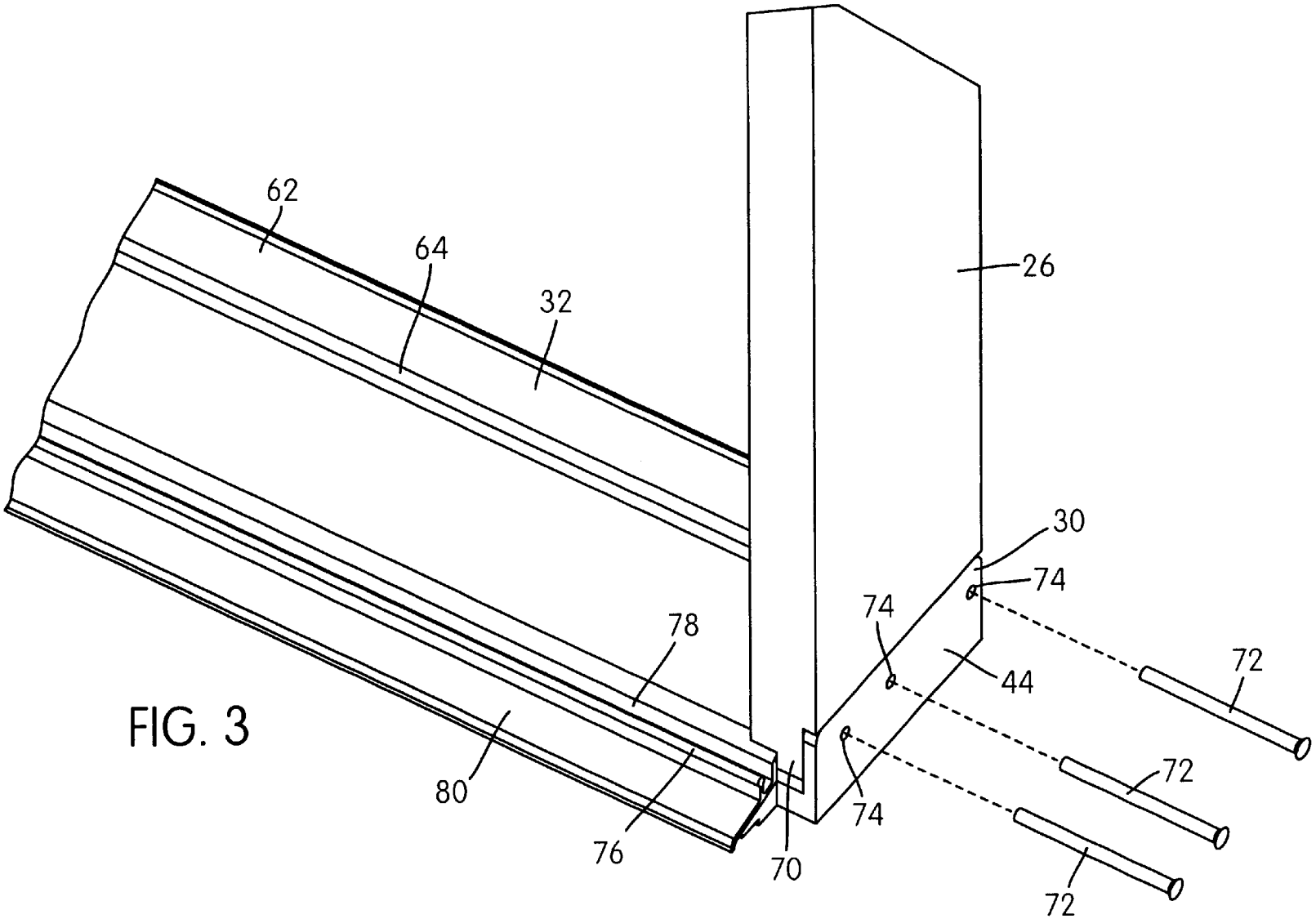
FIG. 3 is a close-up perspective view showing the are where the door sill assembly is connected to one of the door frame side jambs.
Figure 4:
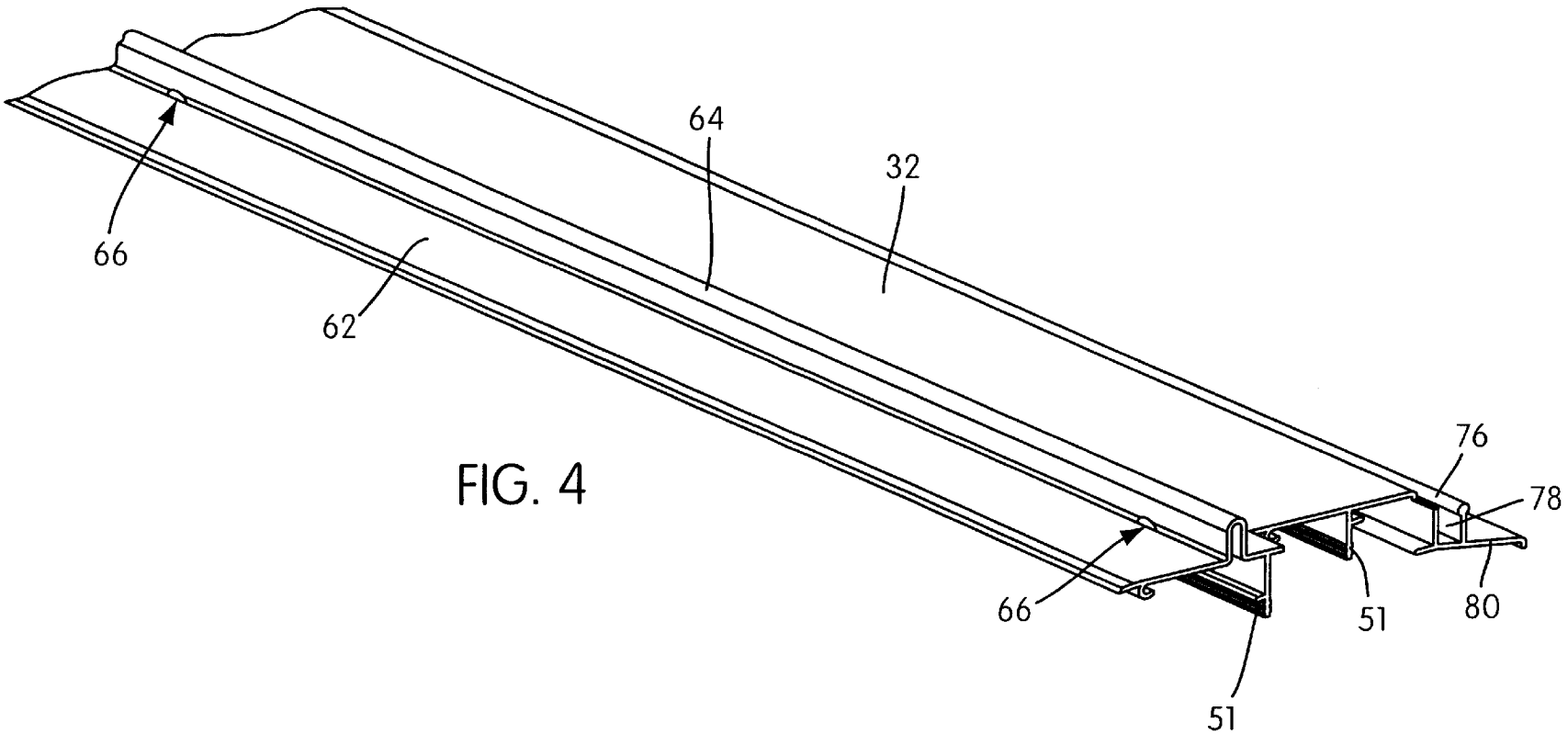
FIG. 4 is a perspective view showing part of the tread of the door sill assembly from the rear thereof to depict the weepholes formed in the wall thereof.

It can be appreciated best from viewing FIG. 3 that when the door frame assembly 10 is fully assembled, the door jambs 24,26 are received inside the end walls 42,44 of the sub-sill 30 and fixed in place by fasteners 72 that are inserted through openings 74 formed through the end walls 42,44. Specifically, each side jamb 24,26 has a projection 70 extending downwardly therefrom and into the trough 54 between the end wall 42,44 and the associated end of the tread structure 32. As a result of this construction, liquid flowing from the building interior towards the building exterior at the end of the tread structure 32 flows down along the side jambs 24,26 and into the sub-sill trough 54. It can be said that the side jambs "funnel" the liquid into the trough 54. The usual way in which fluid will flow towards the area where the door jambs 24,26 and the tread structure 32 meet is that the lip 64 on the tread structure 32 guides some of the fluid laterally towards the jambs 24,26. The advantage of this construction is that there is no need for gaskets between the jambs 24,26 and the end walls 42,44 of the sub-sill 30 because the fluid drains along the jambs 24,26 directly into the sub-sill trough 54. In contrast, in arrangements where the jambs are secured to the outside of the end walls requires rubber seals or gaskets to prevent fluid from leaking between the end walls and the jambs into the sub-floor.

Thus, it can be appreciated that the door sill assembly 28 of the present invention provides an effective arrangement for draining water and other liquids flowing through or attempting to flow through the doorway to the exterior of the building and preventing the water or other liquids from leaking into the building interior or sub-floor between the door jambs 24,26 and the sub-sill 30. The open trough 54 of the sub-sill 30 provides the door sill assembly 30 with a relative large fluid capacity for handling liquid drainage. Specifically, the liquid is allowed to flow freely along the surface of the bottom wall 40 between and around the mounting structures 50 and out the openings 56 in the front wall 46. The fluid is not confined to particular grooves and channels in the sub-sill 30. The advantage of this open trough construction is that, when a high wind is blowing directly on the building exterior and into the sub-sill 30 via openings 56, the wind can flow over the top of the water contained in the trough 54 and out through the weepholes 66. This prevents the wind from creating a high pressure situation in the trough 54 and either forcing water out of the trough 54 or inhibiting water from entering the trough 54. This arrangement is desirable over arrangements with grooves for guiding the liquid because in arrangements with grooves there is no space for the wind to flow over the liquid if the grooves are filled with liquid. In this event, a high pressure situation occurs and the wind may displace some of the liquid out from the sub-sill 30 through the weepholes 66.

Turning now to the method of the present invention, the sub-sill 30 is formed from three separate injection molded components—a first sub-sill end portion 34, a second sub-sill end portion 36, and an intermediate sub-sill portion 38. For reasons which will be discussed hereinbelow, the first and second end portions 34, 36 may be collectively referred to as a first sub-sill portion and the intermediate sub-sill portion 38 may be referred to as a second sub-sill portion. In accordance with the method of the present invention, a plurality of the first sub-sill end portions are formed. Specifically, the sub-sill end portions 34,36 are injection molded in a single shot operation and then separated from one another after solidification. Alternatively, the sub-sill end portions 34,36 may be molded in separate injection molding dies and/or machines, but it is more cost-effective to use a single mold that has a cavity that can form both end portions 34,36. Combined, each pair of sub-sill end portions 34, 36 will have generally the same effective length in the lengthwise direction of a completed sub-sill.

A plurality of the second sub-sill portions of varying lengths are also formed. The plurality includes at least (a) second sub-sill portions each having a first length that will provide a first completed sub-sill with a first predetermined total length selected to extend along the lower edge of a selected doorway between first and second side jambs when the second sub-sill portions having the first length are connected to the first sub-sill portions and (b) second sub-sill portions each having a second length that will provide a second completed sub-sill with a second predetermined total length selected to extend along the lower edge of a selected doorway between first and second side jambs when the second sub-sill portions having the second length are connected to the first sub-sill portions. In the illustrated embodiment, the intermediate sub-sill portions 38 constituting the second sub-sill portions are formed separately from the end portions 34,36 in another injection molding operation, or they may be formed in the same single shot molding operation with the end portions 34, 36. Alternatively, the intermediate sub-sill portions 38 could be extruded. After the intermediate sub-sill portions 38 re solidified, they are then cut down to appropriate first and second lengths. As mentioned above, these lengths are chosen so that the total length of the completed sub-sills 30 allows the assembled sub-sills 30 to fully extend between the side jambs 24,26 along the lower edges of doorways 12 for which they are designed.

Then, the intermediate sub-sill portions 38 (i.e., the second sub-sill portions) having the first length are connected in end to end relation to a first multiplicity of the first sub-sill portions (i.e., the sub-sill end portions 34, 36) to form a multiplicity of first completed sub-sills each having the aforesaid first predetermined total length. The intermediate sub-sill portions 38 having the second length are connected in end to end relation to a second multiplicity of the first sub-sill portions to form a multiplicity of second completed sub-sills each having the aforesaid predetermined second length. Specifically, the sub-sill portions are adhered or plastic welded together in end to end relation to form a leakproof seam between each portion. Then, the tread 32 is assembled to the completed sub-sill.

It can be appreciated that the method of the present invention allows a single assembly set-up to be used to form sub-sills of varying lengths simply by cutting the intermediate sub-sill portion 38 down to a length that provides the assembled sub-sill with it desired length. An alternative to cutting the intermediate portion 38 is to use a first and second inserts in the injection mold that occupies part of the molding cavity so that intermediate sub-sill portions 38 is molded to its desired first or second lengths (depending on which insert is used) without the need for cutting. A variety of different mold inserts could be used for molding intermediate sub-sill portions 38 of varying lengths. The method of the present invention is not limited to embodiment disclosed and may be used to form door sill assemblies having any type of configuration.

In the broadest aspects of the present invention, the sub-sill 30 may be formed by forming a number of sub-sill portions with one of the portions having a length that is chosen so that the combined length of the sub-sill 30 is equal to a length that allows the assembled sub-sill 30 to fully extend between the side jambs 24,26 along the lower edge of the doorway 12. The number of portions may be two or more. Thus, within the principles of the present invention it is contemplated to mold the two end portions and then trim or cut one of them down to size and connect them together without the intermediate portion. However, it is preferred to use the intermediate sub-sill portion 38 in the method the present invention.

It can thus be seen that the objects of the present invention have been fully and effectively accomplished by the illustrated embodiment. It is to be understood that the illustrated embodiment is provided for the purposes of illustrating the structural and functional principles of the present invention and is not intended to be limiting. To the contrary, the present invention is intended to encompass all changes, modifications, alterations, and substitutions within the spirit and scope of the appended claims.

What is claimed:

1. A door frame assembly constructed and arranged to be installed in a doorway located at an exterior of a building in conjunction with a door panel movable between open and closed positions with respect to the doorway, said door frame assembly comprising:

first and second side jambs constructed and arranged to be mounted along first and second generally vertically extending sides of the doorway;

door sill assembly constructed and arranged to be mounted along a lower edge of the doorway between said first and second side jambs, said door sill assembly comprising:

a sub-sill having a peripheral wall including a bottom wall, first and second end walls extending generally upwardly from said bottom wall at opposing end portions of said sub-sill, a rear wall extending generally upwardly from and generally longitudinally between said end walls, and a front wall extending generally upwardly from and generally longitudinally between said end walls opposite said rear wall, said walls of said sub-sill providing interior surfaces that cooperate to define an open fluid-receiving trough extending between said front and rear walls and said first and second end walls, said peripheral wall having one or more openings formed therethrough to allow fluid in the trough to drain from the trough to the building exterior when said door frame assembly is installed in the doorway with said front wall facing the building exterior, said end and rear walls being constructed and arranged to prevent fluid in the trough from flowing into the building interior, a tread structure mounted to said sub-sill so as to cover said sub-sill, said tread structure and said sub-sill being constructed and arranged such that fluid flowing over said tread structure towards building interior is directed into the trough of said sub-sill and then is allowed to drain out from said trough to the building exterior through the one or more openings in the peripheral wall of said sub-sill, said first and second side jambs and said door sill assembly being constructed and arranged such that said first and second side jambs connect to the opposing end portions of said sub-sill with portions of said first and second side jambs extending inside said first and second end walls, respectively, and downwardly into said trough adjacent opposing end portions of said tread structure so that fluid flowing over said tread structure towards the building interior adjacent to said first and second side jambs is allowed to flow downwardly into the trough of said sub-sill between said tread structure and said side jambs and then is allowed to drain out from said trough to the building exterior through the one or more openings in the peripheral wall of said sub-sill.

2. A door frame assembly according to claim 1, wherein said sub-sill is formed from molded plastic and wherein said tread structure is formed from metal.

3. A door frame assembly according to claim 1, wherein said sub-sill has a plurality of tread structure supporting structures extending upwardly from said bottom wall thereof within said trough, said tread structure supporting structures supporting said tread structure from an underside surface thereof.

4. A door frame assembly according to claim 3, wherein said tread structure supporting structures each have a groove formed thereon and wherein said tread structure has structure depending downwardly therefrom and received within said grooves.

5. A door frame assembly according to claim 1, wherein said tread structure has a laterally extending groove constructed and arranged to guide fluid flowing on said tread structure to opposing ends thereof.

6. A door frame assembly according to claim 1, wherein said tread structure has weepholes formed therethrough, said weepholes enabling fluids flowing over said tread structure to flow into said trough of said sub-sill.

7. A door frame assembly according to claim 6, wherein said tread structure has a door panel engaging lip extending upwardly therefrom that is constructed and arranged to engage an underside surface of the door panel in the closed position thereof.

8. A door frame assembly according to claim 7, wherein said weepholes are formed adjacent a rearward side of said lip.

9. A door frame assembly according to claim 8, wherein said tread structure has a sliding door panel supporting lip extending upwardly therefrom and spaced forwardly of the door panel engaging lip, said sliding door panel supporting lip being constructed and arranged to support a sliding door thereon for supported sliding or rolling movements.

10. A door frame assembly according to claim 1, further comprising a top rail constructed and arranged to be mounted along a top edge of the doorway in generally perpendicular relation with respect to said first and second side jambs.

11. A door sill assembly constructed and arranged to be mounted along a lower edge of the doorway between first and second side jambs installed in a doorway located at an exterior of a building in conjunction with a door panel movable between open and closed positions with respect to the doorway, said door sill assembly comprising:

a sub-sill having a peripheral wall including a bottom wall, first and second end walls extending generally upwardly from said bottom wall at opposing end portions of said sub-sill, a rear wall extending generally upwardly from and generally longitudinally between said end walls, and a front wall extending generally upwardly from and generally longitudinally between said end walls opposite said rear wall, said walls of said sub-sill providing interior surfaces that cooperate to define an open fluid-receiving trough extending between said front and rear walls and said first and second end walls, said peripheral wall having one or more openings formed therethrough to allow fluid in the trough to drain from the trough to the building exterior when said door frame assembly is installed in the doorway with said front wall facing the building exterior, said end and rear walls being constructed and arranged to prevent fluid in the trough from flowing into the building interior, a tread structure mounted to said sub-sill so as to cover said sub-sill, said tread structure and said sub-sill being constructed and arranged such that fluid flowing over said tread structure towards building interior is directed into the trough of said sub-sill and then is allowed to drain out from said trough to the building exterior through the one or more openings in the peripheral wall of said sub-sill, said door sill assembly being constructed and arranged such that the opposing end portions of said sub-sill connect with the first and second side jambs with portions of the first and second side jambs extending inside said first and second end walls, respectively, and downwardly into said trough adjacent opposing end portions of said tread structure so that fluid flowing over said tread structure towards the building interior adjacent to said first and second side jambs is allowed to flow downwardly into the trough of said sub-sill between said tread structure and said side jambs and then is allowed to drain out from said trough to the building exterior through the one or more openings in the peripheral wall of said sub-sill.

12. A door sill assembly according to claim 11, wherein said sub-sill is formed from molded plastic and wherein said tread structure is formed from metal.

13. A door sill assembly according to claim 11, wherein said sub-sill has a plurality of tread structure supporting structures extending upwardly from said bottom wall thereof within said trough, said tread structure supporting structures supporting said tread structure from an underside surface thereof.

14. A door sill assembly according to claim 13, wherein said tread structure supporting structures each have a groove formed thereon and wherein said tread structure has structure depending downwardly therefrom and received within said grooves.

15. A door sill assembly according to claim 11, wherein said tread structure has a laterally extending groove constructed and arranged to guide fluid flowing on said tread structure to opposing ends thereof.

16. A door sill assembly according to claim 11, wherein said tread structure has weepholes formed therethrough, said weepholes enabling fluids flowing over said tread structure to flow into said trough of said sub-sill.

17. A door sill assembly according to claim 16, wherein said tread structure has a door panel engaging lip extending upwardly therefrom that is constructed and arranged to engage an underside surface of the door panel in the closed position thereof.

18. A door sill assembly according to claim 17, wherein said weepholes are formed adjacent a rearward side of said lip.

19. A door sill assembly according to claim 18, wherein said tread structure has a sliding door panel supporting lip extending upwardly therefrom and spaced forwardly of the door panel engaging lip, said sliding door panel supporting lip being constructed and arranged to support a sliding door thereon for supported sliding or rolling movements.

20. A door assembly for installation in a doorway located at an exterior of a building, said door assembly comprising:

a door frame assembly comprising:

first and second side jambs constructed and arranged to be mounted along first and second generally vertically extending sides of the doorway;

a door sill assembly constructed and arranged to be mounted along a lower edge of the doorway between said first and second side jambs, said door sill assembly comprising:

a sub-sill having a peripheral wall including a bottom wall, first and second end walls extending generally upwardly from said bottom wall at opposing end portions of said sub-sill, a rear wall extending generally upwardly from and generally longitudinally between said end walls, and a front wall extending generally upwardly from and generally longitudinally between said end walls opposite said rear wall, said walls of said sub-sill providing interior surfaces that cooperate to define an open fluid-receiving trough extending between said front and rear walls and said first and second end walls, said peripheral wall having one or more openings formed therethrough to allow fluid in the trough to drain from the trough to the building exterior when said door frame assembly is installed in the doorway with said front wall facing the building exterior, said end and rear walls being constructed and arranged to prevent fluid in the trough from flowing into the building interior, a tread structure mounted to said sub-sill so as to cover said sub-sill, said tread structure and said sub-sill being constructed and arranged such that fluid flowing over said tread structure towards building interior is directed into the trough of said sub-sill and then is allowed to drain out from said trough to the building exterior through the one or more openings in the peripheral wall of said sub-sill, said first and second side jambs and said door sill assembly being constructed and arranged such that said first and second side jambs connect to the opposing end portions of said sub-sill with portions of said first and second side jambs extending inside said first and second end walls, respectively, and downwardly into said trough adjacent opposing end portions of said tread structure so that fluid flowing over said tread structure towards the building interior adjacent to said first and second side jambs is allowed to flow downwardly into the trough of said sub-sill between said tread structure and said side jambs and then is allowed to drain out from said trough to the building exterior through the one or more openings in the peripheral wall of said sub-sill; and a door panel constructed and arranged to be mounted to said door frame assembly for movement between an open position wherein said door panel uncovers the doorway to allow passage therethrough and a closed position wherein said door panel covers the doorway to prevent passage therethrough.

21. A door assembly according to claim 20, wherein said door panel is a swing door panel pivotally mounted to one of said first and second side jambs for pivotal movement between said open and closed positions thereof.

22. A door assembly according to claim 20, wherein said door panel is supported for generally rectilinear movement between said open and closed positions thereof.

23. A door frame assembly constructed and arranged to be installed in a doorway located at an exterior of a building in conjunction with a door panel movable in a generally rectilinear manner between open and closed positions with respect to the doorway, said door frame assembly comprising:

first and second side jambs constructed and arranged to be mounted along first and second generally vertically extending sides of the doorway;

a door sill assembly constructed and arranged to be mounted along a lower edge of the doorway between said first and second side jambs, said door sill assembly comprising:

a sub-sill having surfaces defining an interior fluid receiving space which has one or more openings to allow fluid therein to drain therefrom to the building exterior when said door frame assembly is installed in the doorway, said sub-sill being constructed and arranged to prevent fluid in the fluid receiving space from flowing into the building interior, a tread structure mounted to said sub-sill so as to cover said sub-sill, said tread structure and said sub-sill being constructed and arranged such that fluid flowing over said tread structure towards building interior is directed into the fluid receiving space of said sub-sill and then is allowed to drain out to the building exterior through said one or more openings, said tread structure providing a door panel supporting lip extending generally upwardly therefrom, said lip being constructed and arranged such that the rectilinearly movable door panel can be mounted on said lip and supported thereby for generally rectilinear movement between opened and closed positions, said tread structure having structure that cooperates with said lip to define a groove extending alongside said lip rearwardly thereof, said groove being configured to guide fluid flowing over said lip towards the opposing ends of said tread structure for drainage to the exterior of the building;

said first and second side jambs and said door sill assembly being constructed and arranged such that said first and second side jambs connect to the opposing end portions of said sub-sill in such a manner that fluid flowing over said tread structure towards the building interior adjacent to said first and second side jambs is allowed to flow downwardly into the fluid receiving space of said sub-sill between said tread structure and said side jambs and then is allowed to drain out to the building exterior through said one or more openings.

24. A door frame assembly according to claim 23, wherein said sub-sill has a peripheral wall including a bottom wall, first and second end walls extending generally upwardly from said bottom wall at opposing end portions of said sub-sill, a rear wall extending generally upwardly from and generally longitudinally between said end walls, and a front wall extending generally upwardly from and generally longitudinally between said end walls opposite said rear wall, said walls of said sub-sill providing interior surfaces that cooperate to define an open fluid-receiving trough constituting said fluid receiving space extending between said front and rear walls and said first and second end walls, said front wall having said one or openings formed therethrough to allow fluid in the trough to drain from the trough to the building exterior when said door frame assembly is installed in the doorway with said front wall facing the building exterior, said end and rear walls being constructed and arranged to prevent fluid in the trough from flowing into the building interior.

25. A door frame assembly according to claim 24, wherein said first and second side jambs and said door sill assembly are constructed and arranged such that said first and second side jambs connect to the opposing end portions of said sub-sill with portions of said first and second side jambs extending inside said first and second end walls, respectively, and downwardly into said trough adjacent opposing end portions of said tread structure so that fluid flowing over said tread structure towards the building interior adjacent to said first and second side jambs is allowed to flow downwardly into the trough of said sub-sill between said tread structure and said side jambs and then is allowed to drain out from said trough to the building exterior through the one or more openings in the front wall of said sub-sill.

26. A door frame assembly according to claim 24, wherein said sub-sill has a plurality of tread structure supporting structures extending upwardly from said bottom wall thereof within said trough, said tread structure supporting structures supporting said tread structure from an underside surface thereof.

27. A door frame assembly according to claim 26, wherein said tread structure supporting structures each have a groove formed thereon and wherein said tread structure has structure depending downwardly therefrom and received within said grooves.

28. A door frame assembly according to claim 23, wherein said groove is positioned such that opposing ends thereof open directly to the building exterior when said door frame assembly is installed in the doorway so that the fluid therein flows directly to the building exterior.

29. A door frame assembly according to claim 23, wherein said sub-sill is formed from molded plastic and wherein said tread structure is formed from metal.

30. A door frame assembly according to claim 23, wherein said tread structure has weepholes formed therethrough, said weepholes enabling fluid flowing over said tread structure to flow into said fluid receiving space of said sub-sill.

31. A door frame assembly according to claim 30, wherein said tread structure has a door panel engaging lip extending upwardly therefrom that is constructed and arranged to engage an underside surface of a swing door panel mounted rearwardly of the sliding door panel in the closed position of said swing door panel.

32. A door frame assembly according to claim 31, wherein said weepholes are formed adjacent a rearward side of said lip.

33. A door frame assembly according to claim 23, further comprising a top rail constructed and arranged to be mounted along a top edge of the doorway in generally perpendicular relation with respect to said first and second side jambs.

34. A door sill assembly constructed and arranged to be mounted along a lower edge of the doorway between first and second side jambs installed in a doorway located at an exterior of a building in conjunction with a door panel movable in a generally rectilinear manner between open and closed positions with respect to the doorway, said door sill assembly comprising:

a sub-sill having surfaces defining an interior fluid receiving space which has one or more openings to allow fluid therein to drain therefrom to the building exterior when said door frame assembly is installed in the doorway, said sub-sill being constructed and arranged to prevent fluid in the fluid receiving space from flowing into the building interior, a tread structure mounted to said sub-sill so as to cover said sub-sill, said tread structure and said sub-sill being constructed and arranged such that fluid flowing over said tread structure towards building interior is directed into the fluid receiving space of said sub-sill and then is allowed to drain out to the building exterior through said one or more openings, said tread structure providing a door panel supporting lip extending generally upwardly therefrom, said lip being constructed and arranged such that the rectilinearly movable door panel can be mounted on said lip and supported thereby for generally rectilinear movement between opened and closed positions, said tread structure having structure that cooperates with said lip to define a groove extending alongside said lip rearwardly thereof, said groove being configured to guide fluid flowing over said lip towards the opposing ends of said tread structure for drainage to the exterior of the building;

said sub-sill being constructed and arranged such that opposing end portions thereof connect to the first and second side jambs in such a manner that fluid flowing over said tread structure towards the building interior adjacent to said first and second side jambs is allowed to flow downwardly into the fluid receiving space of said sub-sill between said tread structure and said side jambs and then is allowed to drain out to the building exterior through said one or more openings.

35. A door sill assembly according to claim 24, wherein said sub-sill has a peripheral wall including a bottom wall, first and second end walls extending generally upwardly from said bottom wall at opposing end portions of said sub-sill, a rear wall extending generally upwardly from and generally longitudinally between said end walls, and a front wall extending generally upwardly from and generally longitudinally between said end walls opposite said rear wall, said walls of said sub-sill providing interior surfaces that cooperate to define an open fluid-receiving trough constituting said fluid receiving space extending between said front and rear walls and said first and second end walls, said front wall having said one or more openings formed therethrough to allow fluids in the trough to drain from the trough to the building exterior when said door frame assembly is installed in the doorway with said front wall facing the building exterior, said end and rear walls being constructed and arranged to prevent fluid in the trough from flowing into the building interior.

36. A door sill assembly according to claim 35, wherein said first and second side jambs and said door sill assembly are constructed and arranged such that said first and second side jambs connect to the opposing end portions of said sub-sill with portions of said first and second side jambs extending inside said first and second end walls, respectively, and downwardly into said trough adjacent opposing end portions of said tread structure so that fluid flowing over said tread structure towards the building interior adjacent to said first and second side jambs is allowed to flow downwardly into the trough of said sub-sill between said tread structure and said side jambs and then is allowed to drain out from said trough to the building exterior through the one or more openings in the front wall of said sub-sill.

37. A door sill assembly according to claim 35, wherein said sub-sill has a plurality of tread structure supporting structures extending upwardly from said bottom wall thereof within said trough, said tread structure supporting structures supporting aid tread structure from an underside surface thereof.

38. A door sill assembly according to claim 37, wherein said tread structure supporting structures each have a groove formed thereon and wherein said tread structure has structure depending downwardly therefrom and received within said grooves.

39. A door sill assembly according to claim 34, wherein said groove is positioned such that opposing ends thereof open directly to the building exterior when said door frame assembly is installed in the doorway so that the fluid therein flows directly to the building exterior.

40. A door sill assembly according to claim 34, wherein said sub-sill is formed from molded plastic and wherein said tread structure is formed from metal.

41. A door sill assembly according to claim 34, wherein said tread structure has weepholes formed therethrough, said weepholes enabling fluid flowing over said tread structure to flow into said fluid receiving space of said sub-sill.

42. A door sill assembly according to claim 41, wherein said tread structure has a door panel engaging lip extending upwardly therefrom that is constructed and arranged to engage an underside surface of a swing door panel mounted rearwardly of the sliding door panel in the closed position of said swing door panel.

43. A door sill assembly according to claim 42, wherein said weepholes are formed adjacent a rearward side of said lip.

44. A door assembly for installation in a doorway located at an exterior of a building, said door assembly comprising:

a door frame assembly comprising:

first and second side jambs constructed and arranged to be mounted along first and second generally vertically extending sides of the doorway;

a door sill assembly constructed and arranged to be mounted along a lower edge of the doorway between said first and second side jambs, said door sill assembly comprising:

a sub-sill having surfaces defining an interior fluid receiving space which has one or more openings to allow fluid therein to drain therefrom to the building exterior when said door frame assembly is installed in the doorway, said sub-sill being constructed and arranged to prevent fluid in the fluid receiving space from flowing into the building interior, a tread structure mounted to said sub-sill so as to cover said sub-sill, said tread structure and said sub-sill being constructed and arranged such that fluid flowing over said tread structure towards building interior is directed into the fluid receiving space of said sub-sill and then is allowed to drain out to the building exterior through said one or more openings, said tread structure providing a door panel supporting lip extending generally upwardly therefrom, said tread structure having structure that cooperates with said lip to define a groove extending alongside said lip rearwardly thereof, said groove being configured to guide fluid flowing over said lip towards the opposing ends of said tread structure for drainage to the exterior of the building;

said first and second side jambs and said door sill assembly being constructed and arranged such that said first and second side jambs connect to the opposing end portions of said sub-sill in such a manner that fluid flowing over said tread structure towards the building interior adjacent to said first and second side jambs is allowed to flow downwardly into the fluid receiving space of said sub-sill between said tread structure and said side jambs and then is allowed to drain out to the building exterior through said one or more openings; and a door panel constructed and arranged to be mounted on and supported by said lip extending generally upwardly from the tread structure of said door sill assembly for generally rectilinear movement between an open position wherein said door panel uncovers the doorway to allow passage therethrough and a closed position wherein said door panel covers the doorway to prevent passage therethrough.

* * * * *